US007142798B2

(12) United States Patent
Martin

(10) Patent No.: US 7,142,798 B2
(45) Date of Patent: Nov. 28, 2006

(54) CARRIER BEAD PICKOFF DEVICE

(75) Inventor: Scott A. Martin, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 60 days.

(21) Appl. No.: 10/994,452

(22) Filed: Nov. 22, 2004

(65) Prior Publication Data

US 2006/0110188 A1 May 25, 2006

(51) Int. Cl.
*G03G 15/095* (2006.01)
*G03G 21/00* (2006.01)

(52) U.S. Cl. ..... 399/264; 399/343; 399/356

(58) Field of Classification Search ..... 399/264, 399/98, 99, 343, 356, 358, 360
See application file for complete search history.

(56) References Cited

U.S. PATENT DOCUMENTS 5,081,503 A 1/1992 Parker et al.
5,379,094 A * 1/1995 Wing et al. ..... 399/264
5,391,455 A 2/1995 Bigelow
5,404,215 A 4/1995 Bares

* cited by examiner

*Primary Examiner*—Hoang Ngo
(74) *Attorney, Agent, or Firm*—Tallam I Nguti

(57) ABSTRACT

A carrier bead pickoff device is provided for removing ferromagnetic carrier beads from a developed image-carrying surface of a moving photoreceptor in an electrostatographic image reproduction machine. The carrier bead pickoff device includes (a) an elongate stationary core having a first elongate segment, and a second elongate segment, the second elongate segment including a primary magnetic member for generating a concentrated magnetic field within a pickoff region locatable proximate the developed image-carrying surface; (b) a rotatable, non-ferromagnetic cylindrical shell mounted co-axially over the elongate stationary core and having a first end, a second end, and a shell wall having a smooth outer surface; and (c) at least one elongate ferromagnetic strip formed over a portion of the smooth outer surface (i) for rotation with the portion, (ii) for temporary magnetization when rotating through the concentrated magnetic field within the pickoff region, and (iii) for contacting and retaining ferromagnetic carrier beads, attracted by the primary magnetic member towards the smooth outer surface, during rotation of the portion of the smooth outer surface through the pickoff region.

20 Claims, 3 Drawing Sheets

CARRIER BEAD PICKOFF DEVICE

The present disclosure relates to electrostatographic printing or image reproduction machines, and particularly to an improved pickoff device for removing developer beads, which can remain on the surface of a photoreceptor after leaving a latent electrostatic image development apparatus in such machines.

In electrostatographic image reproduction machines, the moving surface of a photoreceptor is charged to a substantially uniform potential during passage through a charging station, and then, during passage through an imaging station, the charged developed image-carrying surface is exposed to a light image of an original document to be copied. The light image selectively discharges portions of the charged photoreceptor surface to produce a latent electrostatic image replicating the original document. This latent image is then translated through a development station where it is developed by contacting the developed image-carrying surface with developer powder or toner to create a powder image conforming to the latent electrostatic image. The powder image moves with the photoreceptor to a transfer station where it is transferred or offset printed onto a copy sheet. The transferred powder image is fused to the copy sheet surface, thereby creating a permanent copy of the original document. The photoreceptor then returns to the charging station through a cleaning station where residual toner is removed from the developed image-carrying surface.

In the case where the development station apparatus uses a two-component developer material to develop the latent electrostatic image into a powder image, fine toner particles or powder are made to adhere to the surfaces of coarse, ferromagnetic carrier granules or beads by triboelectric attraction. This two-component developer is brought into contact with the developed image-carrying surface by suitable means, such as a magnetic brush forming roller, to transfer toner from the carrier beads to the latent electrostatic image, thereby creating the conforming powder image. Unfortunately, some of the carrier beads may also be attracted to the developed image-carrying surface and are held there with the powder image upon exiting the development station. This phenomenon, known as "bead carry-out" can be a persistent problem in electrostatographic image reproduction machines. In the transfer station, these spurious, adhering carrier beads prevent localized intimate contact between the copy sheet surface and the toner particles of the powder image, thereby causing copy deletions that degrade copy quality. Moreover, if these spurious carrier beads remain attracted to the developed image-carrying surface as it goes through the cleaning station, they can abrade the developed image-carrying surface as they are mechanically removed by a rotating cleaning brush. It is therefore highly desirable that all such spurious carrier beads leaving the development station on the developed image-carrying surface be removed prior to arrival at the transfer station. It is also desirable that the removal of these carrier beads from the developed image-carrying surface be achieved without disturbing the powder image.

Another important consideration is that a carrier bead pickoff device structured to achieve these desired objectives be as compact and as less costly as possible, since costs and available space within the confines of an electrostatographic image reproduction machine are aspects of concern.

Examples of prior efforts can be found in U.S. Pat. No. 5,081,503 entitled "Compact magnetic bead pick-off device" that disclose a carrier bead pick-off device that includes a magnet assembly and an enclosure in which the magnet assembly is reciprocated between a first position where carrier beads are picked off the photoreceptor and a second position where the carrier beads are caused to be returned to a developer housing structure. The enclosure in one embodiment of the invention forms part of the developer housing structure. The magnet is retracted such that it follows the contour of the enclosure so that the carrier beads are swept into the developer housing structure.

U.S. Pat. No. 5,391,455 entitled "Pick-off roll for DAD development to preserve developer conductivity and reduce photoreceptor filming" discloses a process in which additives contained in developer material used for developing latent electrostatic images on a charge retentive surface are intercepted prior to the developer material being moved into a development zone intermediate to the developer housing containing the developer material and the imaging surface. The additives removed are returned to the developer material for admixing therewith.

U.S. Pat. No. 5,404,215 entitled "Developed bead pick-off device" discloses a process in which to remove ferromagnetic carrier beads from the surface of a photoreceptor leaving a development station in an electrophotographic machine, the carrier beads are magnetically attracted to the surfaced of an elongated, rotating cylinder. The cylinder surface is provided with a raised spiral thread to create a material conveying auger operating to axially convey the attracted beads to a cylinder end portion beyond a side edge of the photoreceptor, where the carrier beads fall into a sump.

SUMMARY

In accordance with the present disclosure, there is provided a carrier bead pickoff device is provided for removing ferromagnetic carrier beads from a developed image-carrying surface of a moving photoreceptor in an electrostatographic image reproduction machine. The carrier bead pickoff device includes (a) an elongate stationary core having a first elongate segment, and a second elongate segment, the second elongate segment including a primary magnetic member for generating a concentrated magnetic field within a pickoff region locatable proximate the developed image-carrying surface; (b) a rotatable, non-ferromagnetic cylindrical shell mounted co-axially over the elongate stationary core and having a first end, a second end, and a shell wall having a smooth outer surface; and (c) at least one elongate ferromagnetic strip formed over a portion of the smooth outer surface (i) for rotation with the portion, (ii) for temporary magnetization when rotating through the concentrated magnetic field within the pickoff region, and (iii) for contacting and retaining ferromagnetic carrier beads, attracted by the primary magnetic member towards the smooth outer surface, during rotation of the portion of the smooth outer surface through the pickoff region.

BRIEF DESCRIPTION OF THE DRAWINGS

For a full understanding of the nature and objects of the present disclosure, reference may be had to the following detailed description, taken in conjunction with the accompanying drawings, in which.

DETAILED DESCRIPTION

Figure 1:
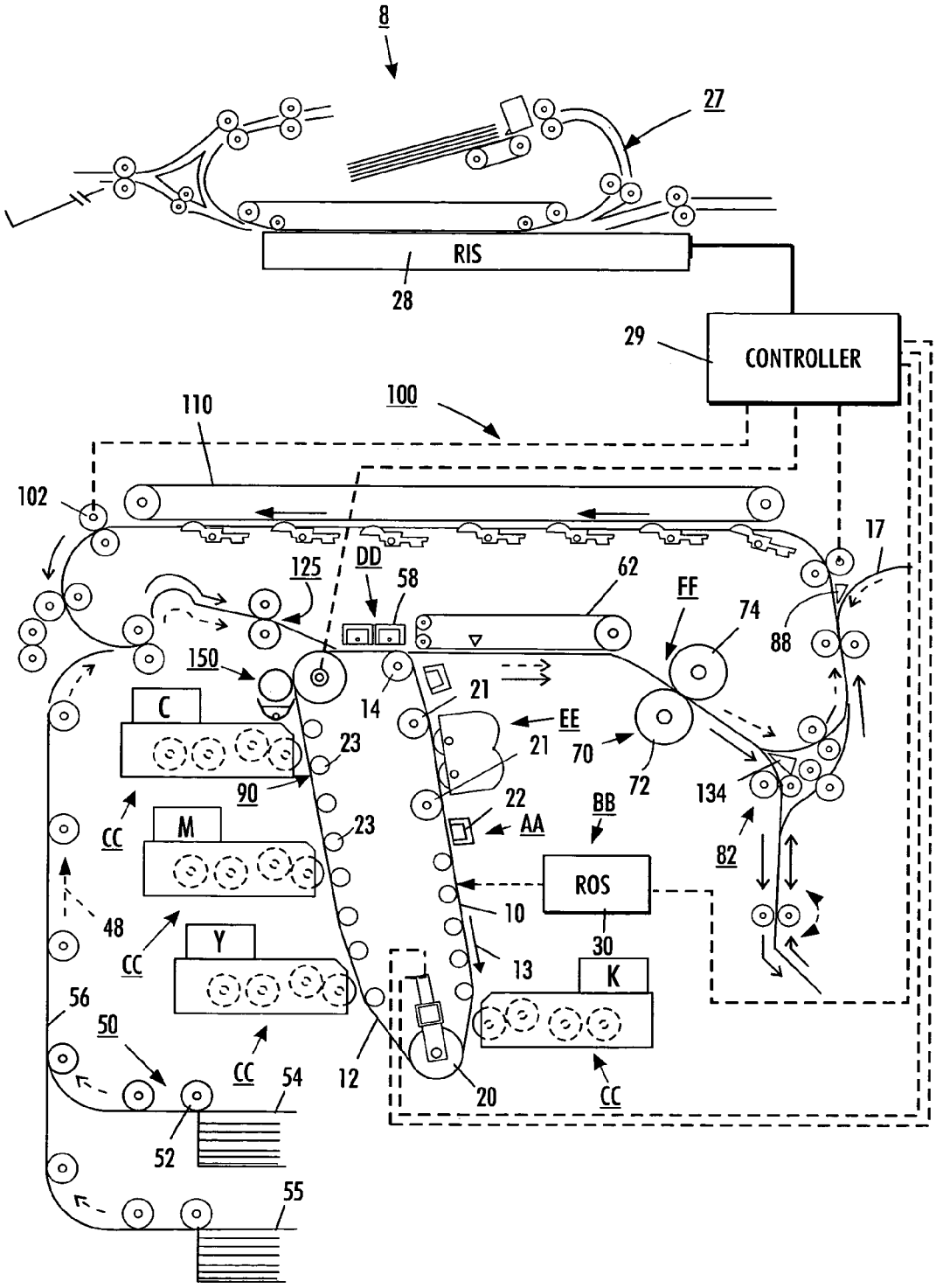
FIG. 1 is a schematic elevational view of an electrostatographic image reproduction machine incorporating the carrier bead pickoff device of the present disclosure.

FIG. 1 schematically illustrates an electrostatographic reproduction machine that generally employs a photoconductive belt 10 mounted on a belt support module. Preferably, the photoconductive belt 10 is made from a photoconductive material coated on a ground layer that, in turn, is coated on an anti-curl backing layer. Belt 10 moves in the direction of arrow 13 to advance successive portions sequentially through the various processing stations disposed about the path of movement thereof. Belt 10 is entrained as a closed loop about stripping roll 14, drive roll 16, and idler roll 21.

Initially, a portion of the photoconductive belt surface passes through charging station AA. At charging station AA, a corona generating device indicated generally by the reference numeral 22 charges the photoconductive belt 10 to a relatively high, substantially uniform potential.

As also shown FIG. 1, the reproduction machine 8 includes a controller or electronic control subsystem (ESS), indicated generally be reference numeral 29 which is preferably a self-contained, dedicated mini-computer having a central processor unit (CPU), electronic storage, and a display or user interface (UI). The ESS 29, with the help of sensors and connections, can read, capture, prepare and process image data and machine status information. As such, it is the main control system for components and other subsystems of machine 8 including the closed loop belt tensioning mechanism 200 of the present invention.

Referring again to FIG. 1, at an exposure station BB, the controller or electronic subsystem (ESS) 29, receives the image signals from RIS 28 representing the desired output image and processes these signals to convert them to a continuous tone or gray scale rendition of the image which is transmitted to a modulated output generator, for example the raster output scanner (ROS), indicated generally by reference numeral 30. The image signals transmitted to ESS 29 may originate from RIS 28 as described above or from a computer, thereby enabling the electrostatographic reproduction machine 8 to serve as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

ROS 30 includes a laser with rotating polygon mirror blocks. Preferably a nine-facet polygon is used. The ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station CC, which includes four developer units containing cmyk color toners, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station DD. A print sheet 48 is advanced to the transfer station DD, by a sheet feeding apparatus 50. Preferably, sheet feeding apparatus 50 includes a feed roll 52 contacting the uppermost sheet of stack 54. Feed roll 52 rotates to advance the uppermost sheet from stack 54 to vertical transport 56. Vertical transport 56 directs the advancing sheet 48 of support material into registration transport 57 past image transfer station DD to receive an image from photoreceptor belt 10 in a timed sequence so that the toner powder image formed thereon contacts the advancing sheet 48 at transfer station DD. Transfer station DD includes a corona-generating device 58, which sprays ions onto the backside of sheet 48. This attracts the toner powder image from photoconductive surface 12 to sheet 48. After transfer, sheet 48 continues to move in the direction of arrow 60 by way of belt transport 62, which advances sheet 48 to fusing station FF.

Fusing station FF includes a fuser assembly indicated generally by the reference numeral 70 that permanently affixes the transferred toner power image to the copy sheet. Preferably, fuser assembly 70 includes a heated fuser roller 72 and a pressure roller 74 with the powder image on the copy sheet contacting fuser roller 72. The pressure roller is crammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent.

The sheet then passes through fuser 70 where the image is permanently fixed or fused to the sheet. After passing through fuser 70, a gate either allows the sheet to move directly via output 17 to a finisher or stacker, or deflects the sheet into the duplex path 100, specifically, first into single sheet inverter 82 here. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 100, where that sheet will be inverted and then fed to acceleration nip 102 and belt transports 110, for recirculation back through transfer station DD and fuser 70 for receiving and permanently fixing the side two image to the backside of that duplex sheet, before it exits via exit path 17.

After the print sheet is separated from photoconductive surface 12 of belt 10, the residual toner/developer and paper fiber particles adhering to photoconductive surface 12 are removed therefrom at cleaning station EE. Cleaning station EE includes a rotatably mounted fibrous brush in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

Figure 2:
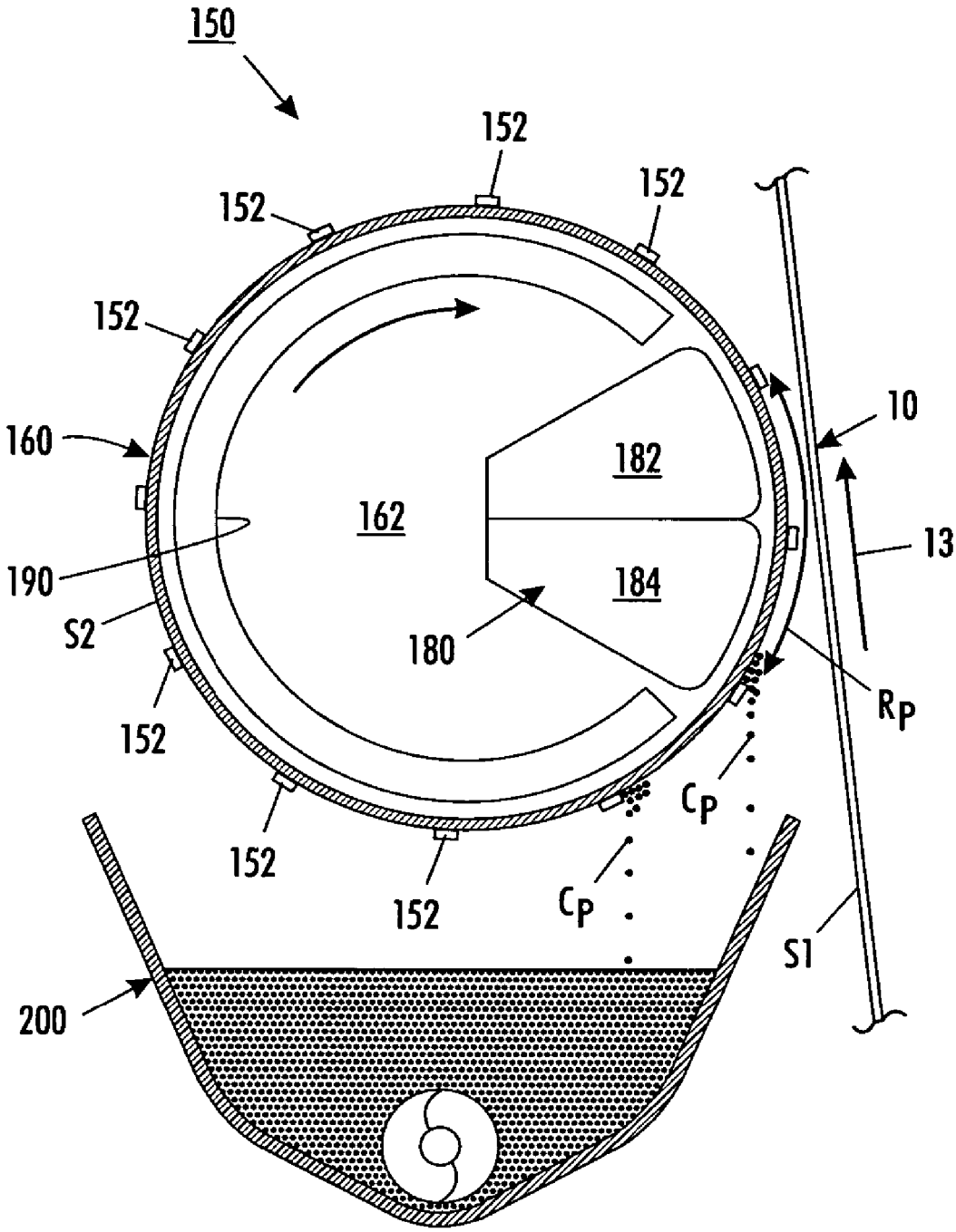
FIG. 2 is an enlarged view, in axial cross section, of the bead pickoff device of the disclosure.
Figure 3:
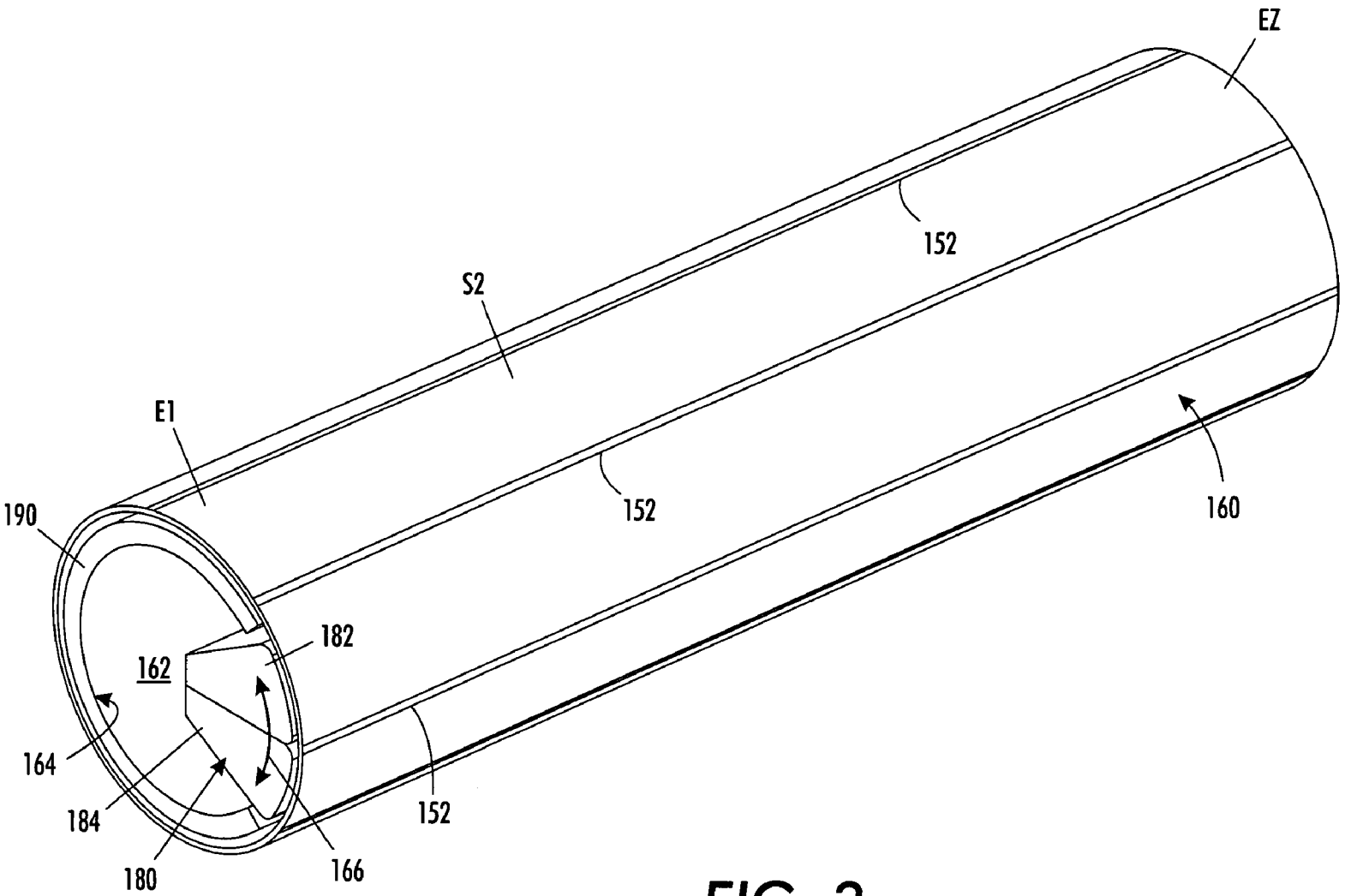
FIG. 3 is a perspective view of the bead pickoff device in accordance with the present disclosure.

Referring now to FIGS. 1–3, in order to remove any ferromagnetic carrier beads that may have become attracted to and held on the image-carrying surface S1 of photoconductive layer 12 following image development at the development station CC, a carrier bead pickoff device, constructed in accordance with the present disclosure and generally designated by the reference number 150 in FIG. 1, is provided. As shown, the carrier bead pickoff device 150 is positioned in closely spaced relation to a path of movement of the surface S1 of photoreceptor 10, and at a location between the development stations CC and transfer station DD.

As illustrated more fully in FIGS. 2 and 3, the carrier bead pickoff device 74 of the present disclosure is suitable for removing ferromagnetic carrier beads from the developed image-carrying surface S1 of the moving photoreceptor 10 in the electrostatographic image reproduction machine 8. As shown, the carrier bead pickoff device 150 includes (a) a rotatable, non-ferromagnetic shell 160 including an elongate stationary core 162 having a first elongate segment 164, and a second elongate segment 166, the second elongate segment 166 including a primary magnetic member 180 for generating a concentrated magnetic field within a pickoff region Rp locatable between the shell 160 and proximate the developed image-carrying surface S1. The rotatable, non-ferromagnetic cylindrical shell 160 is mounted co-axially over the elongate stationary core 162 and has a first end E1, a second end E2, and a shell wall W1 having a smooth outer surface S2. The carrier bead pickoff device 150 also includes at least one elongate ferromagnetic strip 152 formed over a portion of the smooth outer surface S2 of the shell 160 (i) for rotation with such portion, (ii) for temporary magnetization when rotating through the concentrated magnetic field within the pickoff region, and (iii) for contacting and retaining ferromagnetic carrier beads Cp, attracted by the primary magnetic member 180 towards the smooth outer surface S2, during rotation of the portion of the smooth outer surface S2 through the pickoff region Rp.

The carrier bead pickoff device 150 also includes a magnet shunting member 190 mounted within the first segment 164 of the stationary core 162 for minimizing a strength of a magnetic field of the primary magnetic member 180 in regions outside the smooth outer surface S2 and proximate the magnet shunting member 190 as shown. The primary magnetic member 180 comprises a permanent magnet member. The carrier bead pickoff device 150 further includes a carrier bead sump 200 that is associated with the rotatable, non-ferromagnetic cylindrical shell 160, and is located away from the pickoff region Rp, proximate a path of rotation of the at least one elongate ferromagnetic strip 152 on the smooth outer surface S2, for receiving carrier beads Cp released from the at least one elongate ferromagnetic strip 152.

In one embodiment, the carrier bead pickoff device 150 includes a plural number of the at least one elongate ferromagnetic strip 152 as shown. The at least one elongate ferromagnetic strip 152 comprises a straight ferromagnetic wire attached to the first end E1 and to the second end E2 of the rotatable, non-ferromagnetic cylindrical shell 160.

The at least one elongate ferromagnetic strip 152 may equally comprise a straight ferromagnetic powder paint strip 152 painted on the smooth outer surface S1, and extending from the first end E1 to the second end E2 of the rotatable, non-ferromagnetic cylindrical shell 160. The at least one elongate ferromagnetic strip 152 is adapted so that it temporarily magnetized when moving around the second segment 166 of the stationary core 162, and is demagnetized when moving around the first segment 164 of the stationary core 162.

In other words, the carrier bead pickoff device 150 can be seen as including (a) the rotational, elongate cylindrical shell 160 positioned closely adjacent the developed image-carrying surface S1 of the photoreceptor, and oriented transversely to a direction 13 of movement of the developed image-carrying surface, the cylindrical shell having a longitudinal axis and a smooth outer surface S2; (b) an elongate stationary primary magnetic means or member 180 positioned, and extending axially, within the cylindrical shell 160 for generating a concentrated magnetic field within an axially extending pickoff region Rp locatable proximate the developed image-carrying surface S1; and (c) at least one straight strip 152 of ferromagnetic material formed fixedly on a portion of the smooth outer surface S2 of the cylindrical shell 160 (i) for rotation with the portion (ii) for temporary magnetization through the concentrated magnetic field within the pickoff region Rp, and (iii) for contacting and retaining ferromagnetic carrier beads Cp, attracted by the primary magnetic means or member 180 towards the outer surface S2 of the cylindrical shell, during rotation of the portion of the outer surface through the pickoff region Rp. The primary magnetic means or member 180 comprises a pair of magnetic poles 182, 184 of opposite polarity that are arranged in relative angular orientation in a range of 30 degree to 60 degree with each other.

As can be seen, there has been provided a carrier bead pickoff device that includes (a) an elongate stationary core having a first elongate segment, and a second elongate segment, the second elongate segment including a primary magnetic member for generating a concentrated magnetic field within a pickoff region locatable proximate the developed image-carrying surface; (b) a rotatable, non-ferromagnetic cylindrical shell mounted co-axially over the elongate stationary core and having a first end, a second end, and a shell wall having a smooth outer surface; and (c) at least one elongate ferromagnetic strip formed over a portion of the smooth outer surface (i) for rotation with the portion, (ii) for temporary magnetization when rotating through the concentrated magnetic field within the pickoff region, and (iii) for contacting and retaining ferromagnetic carrier beads, attracted by the primary magnetic member towards the smooth outer surface, during rotation of the portion of the smooth outer surface through the pickoff region.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A carrier bead pickoff device for removing ferromagnetic cater beads from a developed image-carrying surface of a moving photoreceptor in an electrostatographic image reproduction machine, the carrier bead pickoff device comprising:

(a) an elongate stationary core having a first elongate segment, and a second elongate segment, said second elongate segment including a primary magnetic member for generating a concentrated magnetic field within a pickoff region locatable proximate the developed image-carrying surface;

(b) a rotatable, non-ferromagnetic cylindrical shell mounted co-axially over said elongate stationary core and having a first end, a second end, and a shell wall having a smooth outer surface; and (c) at least one elongate ferromagnetic strip formed over a portion of said smooth outer surface (i) for rotation with said portion, (ii) for temporary magnetization when rotating through said concentrated magnetic field within said pickoff region, and (iii) for contacting and retaining ferromagnetic carrier beads, attracted by said primary magnetic member towards said smooth outer surface, during rotation of said portion of said smooth outer surface through said pickoff region.

2. The carrier bead pickoff device of claim 1, including a magnet shunting member mounted within said first segment of said stationary core for minimizing a strength of a magnetic field of said primary magnetic member in regions outside said smooth outer surface proximate said magnet shunting member.

3. The carrier bead pickoff device of claim 1, wherein said primary magnetic member comprises a permanent magnet member.

4. The carrier bead pickoff device of claim 1, including a carrier bead sump associated with said rotatable, non-ferromagnetic cylindrical shell and located away from said pickoff region, proximate a path of rotation of said at least one elongate ferromagnetic strip on said smooth outer surface, for receiving carrier beads released from said at least one elongate ferromagnetic strip.

5. The carrier bead pickoff device of claim 1, including a plural number of said at least one elongate ferromagnetic strip.

6. The carrier bead pickoff device of claim 1, wherein said at least one elongate ferromagnetic strip comprises a straight ferromagnetic wire attached to said first end and to said second end of said rotatable, non-ferromagnetic cylindrical shell.

7. The carrier bead pickoff device of claim 1, wherein said at least one elongate ferromagnetic strip comprises a straight ferromagnetic powder paint strip painted on said smooth outer surface and extending from said first end to said second end of said rotatable, non-ferromagnetic cylindrical shell.

8. The carrier bead pickoff device of claim 1, wherein said at least one elongate ferromagnetic strip is temporarily magnetized when moving around said second segment of said stationary core, and is demagnetized when moving around said first segment of said stationary core.

9. A carrier bead pickoff device for removing undesirable ferromagnetic carrier beads from a developed image-carrying surface of a moving photoreceptor during movement of said developed image-carrying surface between a development station AA and an image transfer station of an electrostatographic image reproduction machine, said carrier bead pickoff device comprising:

(a) a rotational, elongate cylindrical shell positioned closely adjacent the developed image-carrying surface of the photoreceptor and oriented transversely to a direction of movement of the developed image-carrying surface, said cylindrical shell having a longitudinal axis and a smooth outer surface;

(b) elongate stationary main magnetic means positioned and extending axially within said cylindrical shell for generating a concentrated magnetic field within an axially extending pickoff region locatable proximate the developed image-carrying surface;

(c ) at least one straight strip of ferromagnetic material formed fixedly on a portion of said smooth outer surface of said cylindrical shell (i) for rotation with said portion (ii) for temporary magnetization through said concentrated magnetic field within said pickoff region, and (iii) for contacting and retaining ferromagnetic carrier beads, attracted by said main magnetic means towards said outer surface of said cylindrical shell, during rotation of said portion of said outer surface through said pickoff region.

10. The carrier bead pickoff device of claim 9, wherein said primary magnetic member comprises a pair of magnetic poles of opposite polarity arranged in relative angular orientation in a range of 30.degree to 60 degree.

11. An electrostatographic reproduction machine comprising:

(a) a moveable imaging member including an imaging surface;

(b) latent imaging means for forming a latent electrostatic toner image on said imaging surface of said moveable imaging member;

(c) a development apparatus mounted adjacent a path of movement of said moveable imaging member, said development apparatus containing two-component developer, including ferromagnetic carrier beads and toner, for developing said latent electrostatic image on said imaging surface into a toner image;

(d) a transfer station for transferring said toner image from said imaging surface onto an image-carrying substrate; and (e) a carder bead pickoff device, mounted adjacent said path of movement of said moveable imaging member and downstream of said development apparatus, relative to movement of said moveable imaging member, for removing undesirable ferromagnetic carrier beads from said toner image on said imaging surface, said carrier bead pickoff device including:

(i) a stationary core having a first segment, and a second segment, said second segment including a primary magnetic member for generating a concentrated magnetic field between said primary magnetic member and imaging surface;

(ii) a rotatable, non-ferromagnetic cylindrical shell mounted co-axially over said stationary core and having a first end, a second end, and a shell wall having a smooth outer surface; and (iii) at least one straight ferromagnetic strip formed over a portion of said smooth outer surface between said first end and said second end of said rotatable, non-ferromagnetic cylindrical shell (i) for rotation with said portion, (ii) for being magnetized temporarily when rotating through said concentrated magnetic field, and (iii) for contacting and retaining ferromagnetic carrier beads, attracted by said primary magnetic member towards said smooth outer surface, during rotation of said portion of said smooth outer surface through said pickoff region.

12. The electrostatic reproduction machine of claim 11, including a magnet shunting member mounted within said first segment of said stationary core for minimizing a strength of a magnetic field of said primary magnetic member in regions outside said smooth cuter surface proximate said magnet shunting member.

13. The electrostatic reproduction machine of claim 11, wherein said primary magnetic member comprises a permanent magnet member.

14. The electrostatic reproduction machine of claim 11, including a carrier bead sump associated with said rotatable, non-ferromagnetic cylindrical shell, said carrier bead sump being located away from said pickoff region, proximate a path of rotation of said at least one elongate ferromagnetic strip on said smooth outer surface, for receiving carrier beads released from said at least one elongate ferromagnetic strip.

15. The electrostatic reproduction machine of claim 11, including a plural number of said at least one elongate ferromagnetic strip.

16. The electrostatic reproduction machine of claim 11, wherein said at least one elongate ferromagnetic strip comprises a straight ferromagnetic wire attached to said first end and to said second end of said rotatable, non-ferromagnetic cylindrical shell.

17. The electrostatic reproduction machine of claim 11, wherein said at least one elongate ferromagnetic strip comprises a straight ferromagnetic powder paint strip painted on said smooth outer surface and extending from said first end to said second end of said rotatable, non-ferromagnetic cylindrical shell.

18. The electrostatic reproduction machine of claim 11, wherein said at least one elongate ferromagnetic strip is temporarily magnetized when moving around said second segment of said stationary core, and is demagnetized when moving around said first segment of said stationary care.

19. The electrostatic reproduction machine defined in claim 11, wherein within said pickoff region, said rotatable, non-ferromagnetic cylindrical shell and said outer surface thereof move in a first direction generally opposite to a second direction of movement of said imaging surface.

20. The electrostatic reproduction machine defined in claim 11, including means for rotatably moving said rotatable, non-ferromagnetic cylindrical shell.

* * * * *